US006738007B1

(12) United States Patent
Stafford

(10) Patent No.: US 6,738,007 B1
(45) Date of Patent: May 18, 2004

(54) RETROFITTING VESSELS TO DEFLECT RADAR SIGNALS

(75) Inventor: Philip K. Stafford, Cheltenham (AU)

(73) Assignee: Tenix Defence Systems PTY LTD, Williamstown (AU)

( * ) Notice: Subject to any disclaimer, the term of this patent is extended or adjusted under 35 U.S.C. 154(b) by 63 days.

(21) Appl. No.: 10/031,934

(22) PCT Filed: Jul. 26, 2000

(86) PCT No.: PCT/AU00/00894

§ 371 (c)(1),
(2), (4) Date: May 14, 2002

(87) PCT Pub. No.: WO01/09562

PCT Pub. Date: Feb. 8, 2001

(30) Foreign Application Priority Data

Jul. 28, 1999 (AU) ..... PQ1894

(51) Int. Cl.[7] ..... H01Q 17/00
(52) U.S. Cl. ..... 342/3; 342/5
(58) Field of Search ..... 342/17, 4, 5, 13, 342/14

(56) References Cited

U.S. PATENT DOCUMENTS 3,233,238 A * 2/1966 Barker ..... 342/2
4,323,605 A * 4/1982 Rush ..... 428/17
5,204,680 A 4/1993 Allington et al.
5,250,950 A 10/1993 Scherrer et al.
5,384,571 A * 1/1995 Myers et al. ..... 342/4
5,436,630 A * 7/1995 Nash ..... 342/2
5,732,904 A * 3/1998 Rieger ..... 244/1 R
5,788,110 A 8/1998 Alhamad

FOREIGN PATENT DOCUMENTS

DE 4341939 6/1995
RU 2075721 3/1997

OTHER PUBLICATIONS

Knott, et al., Radar Cross Section, 2nd Edition, 1993, pp. 277–295.

Derwent Abstract No. 98–412225/35, RU2101658–C1 (Kovalev) Jan. 10, 1998.

* cited by examiner

*Primary Examiner*—Thomas H. Tarcza
*Assistant Examiner*—Brian Andrea
(74) *Attorney, Agent, or Firm*—Clark and Brody

(57) ABSTRACT

The radar signature of a vessel is reduced by retrofitting it with an array (10) of elements (15) fastened to surfaces (14*b*) of the vessel. The elements (15) have planar faces (11–12) so oriented that incident radar signal (20) is reflected away from its angle of incidence.

26 Claims, 3 Drawing Sheets

RETROFITTING VESSELS TO DEFLECT RADAR SIGNALS

FIELD OF INVENTION

The present invention is directed to improvements in or relating to vehicles and structures, and is more particularly directed to methods for reducing the radar signature of structures by directing the radar reflections from structures away from specified directions.

BACKGROUND TO THE INVENTION

Air-borne and water-borne defence vessels are under constant threat of detection and possible attack from non-friendly artillery such as ground-based, sea-going or air-borne weapons systems. Vessel detection is usually by means of radar, since conventional vessels, to a greater or lesser extent, all possess a radar signature.

Radar operates by transmitting a pulse of electromagnetic energy and measuring the time between the transmitted pulse and the receipt of the reflection of the pulse from a target. The range at which a target can be detected is a function of, amongst other things, the intensity of the pulse energy and the size of the target (also known as radar cross-section) with respect to the frequency of operation of the radar. In its simplest form, the best return of the electromagnetic pulse to the radar is generated when the surface reflecting the pulse is normal to the direction from which the pulse is transmitted. In this example, the strength of the return signal is proportional to the square of the area of the surface and the square of the radar frequency.

A number of proposals have been put forward with a view to reducing the radar signature of such vessels. In general these proposals involve purpose-building the vessel with radar cross-section reduction capability. This involves, in the case of a water-borne craft shaping the hull and other components of the craft. One such design is the so-called "stealthy" vehicle. These vehicles are designed so that the shape reflects radar energy away from the threat sectors into more benign areas.

For example, an F117 bomber's threat region is forward and below the aircaft. Hence design is such that energy from a radar signal is reflected upwards and sideways from its angled surface facets. Stealth ships require protection from sea-skimming missiles which normally approach parallel with the sea surface. Such a ship therefore has sloping sides which reflect the radar energy upwards and away from the threat direction. A sharply defined or specular reflected beam emerges, as opposed to a diffuse reflection.

It will be appreciated that vessels incorporating such designs involve significant expense over and above the basic vessel. With tightening of government spending generally and defence budgets specifically, the prospect of replacing an ageing fleet with a new fleet which incorporates an expensive design, even if the des may reduce the likelihood of loss of the vessel when on a war footing, is not an attractive proposition.

For vehicles that are not designed as "stealthy", the usual method of treatment to reduce radar cross-section is to cover the vehicle with a radar absorbent material. These materials are usually electrical attenuators such as carbon granules embedded in a membrane that is then fastened to the vehicle. This material works by attenuating the signal as the pulse energy passes through it towards the reflecting surface, and then again after reflection so that the resulting return signal is reduced. These methods rely on attenuating the radar beam. Radar absorbent materials of this type are expensive to purchase and install, and create major maintenance problems by trapping moisture and dirt and promoting corrosion of the substrate such as the ship super structure. Other proposals for radar absorbency have included the use of absorbent rubber sheets and paints.

SUMMARY OF INVENTION

The present invention accordingly provides in one embodiment a method for retrofitting a vessel to reduce its radar signature, the method including the step of attaching to surfaces of the vessel structure an array comprising a plurality of elements, the elements having reflective surfaces with substantially planar faces, the arrangement being such that when attached to surfaces of the vessel structure the faces are oriented so as to reflect an incident radar signal in a direction away from its direction of incidence for a given range of incident directions.

The present invention provides in another separate embodiment an array when used for retrofitting to a vessel to reduce its radar signature, the array capable of being fastened to surfaces of the vessel structure and comprising a plurality of elements, the elements having reflective surfaces with substantially planar aces, the arrangement being such that when the array is fastened to the vessel structure the faces are oriented so as to reflect an incident radar signal in a direction away from its direction of incidence for a given range of incident directions.

The present invention provides in another separate embodiment a vessel having surfaces of its structure retrofitted with an array according to the invention.

The orientation of the faces is preferably such that the faces are oblique to the direction of incident radar for a given range of incident directions. Preferably any edges defining the boundary of the reflective surfaces are also oriented so as to be oblique to the direction of incident radar. In this embodiment of the invention, with a surface orientation that is oblique to the direction of incident radar, the strength of the return signal is then only proportional to the square of the length of the edge of the surface normal to the incident radar. If the face is oblique to the direction of incident radar, and the edges of the surface are oblique to the direction of incident radar, then only the corners of the surface will reflect as point sources. As points have no spatial dimension, the strength of the return signal from each point will vary inversely with the square of the radar frequency. In this way the radar cross-section of the vessel, and hence its radar signature, can be reduced for a given range of incident radar directions.

The present invention is capable of providing a degree of control over the direction in which electromagnetic waves are redirected, permitting other directions as well as the incident direction to be avoided where required.

A vessel according to the invention is any ship or vehicle requiring defence against radar threat. A vessel structure according to the invention includes any surface on the vessel capable of reflecting a radar signal. The structure will therefore, in the case of a water-borne craft, include the hull, bulkhead, decking, the bridge, any weapons or weapon turrets, and rigging.

In the case of a water-borne craft, incident radar is generally parallel to the sea surface, although naturally in some cases incident radar will emanate from aircraft. In accordance with the invention the reflective surfaces are preferably oriented so as to reflect an incident radar signal by up to about 30 degrees. More preferably the reflective surfaces are oriented so as to reflect an incident radar signal by up to about 15 degrees and more typically by up to about 8 to 10 degrees away from its direction of incidence for a given range of incident directions.

A surface to which an array according to the invention is attached will include substantially vertical surfaces, substantially horizontal surfaces, surfaces disposed at an angle to the vertical, and curved surfaces.

An element according to the invention may take any suitable form. The element will typically be triangular, polyhedral, pyramidal or prismatic in shape or in cross-section. The element may be an elongated triangle, polyhedron or pyramid. The element may be open-sided. It may be a solid figure. Where an element according to the invention defines an apex, the apex will typically be disposed in a region which is forward (colinear with respect to the incident radar signal) relative to the planar faces of the reflective surfaces.

An array according to the invention may take any suitable form. It may be uniform or non-uniform. If uniform, the array may comprise a grid of uniformly spaced elements having reflective surfaces with substantially planar faces. If non-uniform, the array may comprise a plurality of randomly arranged elements having reflective surfaces. The elements may be uniform or non-uniform in shape or cross-section as required.

The arrangement of elements and/or the manner of installation of the array on a vessel structure is preferably such that the facets of the elements reflect the incident radar signal away from the threat direction. The arrangement is also preferably such that the facets of the array do not provide to any appreciable extent internal reflection sources whereby to reduce the likelihood of an incident radar signal being reflected towards an adjacent element in the array and in turn reflected back in the direction of the incident radar signal.

The array arrangements may be such that planar faces of the reflective surfaces of the elements are not all arranged in parallel planes.

An array according to the invention is preferably formed from a lightweight material so as to not substantially increase the overall weight of the vessel. The array may be in the form of a cladding. The elements may include perforations for the purpose of reducing its overall weight. If a perforated element is used, the holes are small relative to the wavelength of the incident radar signal to enable the elements to function as a solid reflector. The size and distribution of the perforations will therefore be dependent on the wavelength of the defined threat. The perforations may comprise elements according to the invention. A typical lightweight and relatively inexpensive material suitable for use in retrofitting methods according to the invention comprises aluminum. The aluminum may comprise a foil. The elements may in an alternative embodiment be formed from a mesh, such as a woven mesh. The mesh will be suitably treated so as to present substantially planar faces. Treatment could include encapsulation within a non metallic structure such as a fibre reinforced resin bonded composite material or between two sheets of glass where light or vision is required. Other materials such as bronze, stainless steel and copper may be used for forming an array according to the invention and are envisaged with the scope of the present invention.

The array may be provided in roll form capable of being cut to facilitate ease of attachment of the any to the vessel. It may be provided in sheet form. The sheet may include stiffening to enhance its rigidity or resilience. The sheet may be elongated. In one embodiment the array comprises a plurality of elongated sheets. The sheets may be joined together in any suitable manner. In another embodiment the array comprises a plate or plurality of plates. The plates may be joined together in any suitable manner.

An element may be formed on or in the array by pressing, impressing, stamping, casting, extrusion or by other suitable means to create the desired substantially planar ace for a reflective surface of the array.

The element is preferably of relatively small thickness. A typical element thickness is in the range of from about 0.25 mm to 15 mm more preferably in the range of from about 1 mm to 6 mm.

An array according to the invention may be attached to the vessel structure in any suitable manner. The array may be screwed, welded or otherwise fastened to the structure. If welded, the array may be stud welded to the structure and secured by means of screws. The screws may be concealed from a given range of incident directions. Other attachment arrangements are envisaged within the scope of the invention.

The array may be releasably attachable to the vessel. This may facilitate ease of maintenance of the vessel structure and/or replacement or modification of the characteristics of the array.

The present invention provides in another separate embodiment a method for retrofitting a building structure to reduce its radar signature, the method including the step of attaching to surfaces of the building structure an array comprising a plurality of elements, the elements having reflective surfaces with substantially planar faces, the arrangement being such that when attached to surfaces of the structure the faces are oriented so as to reflect an incident radar signal in a direction away from its direction of incidence for a given range of incident directions.

The present invention provides in another separate embodiment an array when used for retrofitting a building to reduce its radar signature, the array adapted to be fastened to surfaces of the building and comprising a plurality of elements, the elements having reflective surfaces with substantial planar faces, the arrangement being such that when the array is fastened to the building the faces are oriented so as to reflect an incident radar signal in a direction from its direction of incidence for a given range of incident directions.

The present invention provides in another separate embodiment a building having surfaces retrofitted with an array according to the invention.

A building according to the present invention may include a permanent or temporary structure.

The present invention provides in one particularly preferred embodiment a method for retrofitting a vessel to reduce its radar signature, the method including the step of fastening to surfaces of the vessel structure in elongated sheet form an array comprising a plurality of uniformly shaped elements being triangular, polyhedral pyramidal or prismatic in shape and having reflective surfaces with substantially planar faces, the orientation of the faces and edges defining the boundary of the reflective surfaces being such that the faces and the edges are oblique to the direction of incident radar for a given range of incident directions, the arrangement being such that when fastened to surfaces of the vessel structure the reflective surfaces are oriented so as to reflect an incident radar signal by up to about 30 degrees away from its direction of incidence for a given range of incident directions.

The present invention provides in another particularly preferred embodiment an array when used for retrofitting a vessel to reduce its radar signature, the array adapted to be fastened to surfaces of the vessel structure and comprising a plurality of uniformly shaped elements being triangular, polyhedral pyramidal or prismatic in shape and having reflective surfaces with substantially planar faces, the orientation of the faces and edges defining the boundary of the reflective surfaces being such that the faces and the edges are oblique to the direction of incident radar for a given range of incident directions, the arrangement being such that when the array is fastened to surfaces of the vessel structure the reflective surfaces are oriented so as to reflect an incident radar signal by up to about 30 degrees away from its direction of incidence for a given range of incident directions.

DESCRIPTION OF PREFERRED EMBODIMENT

The present invention will now be described with reference to particularly preferred embodiments, in which.

Figure 1:
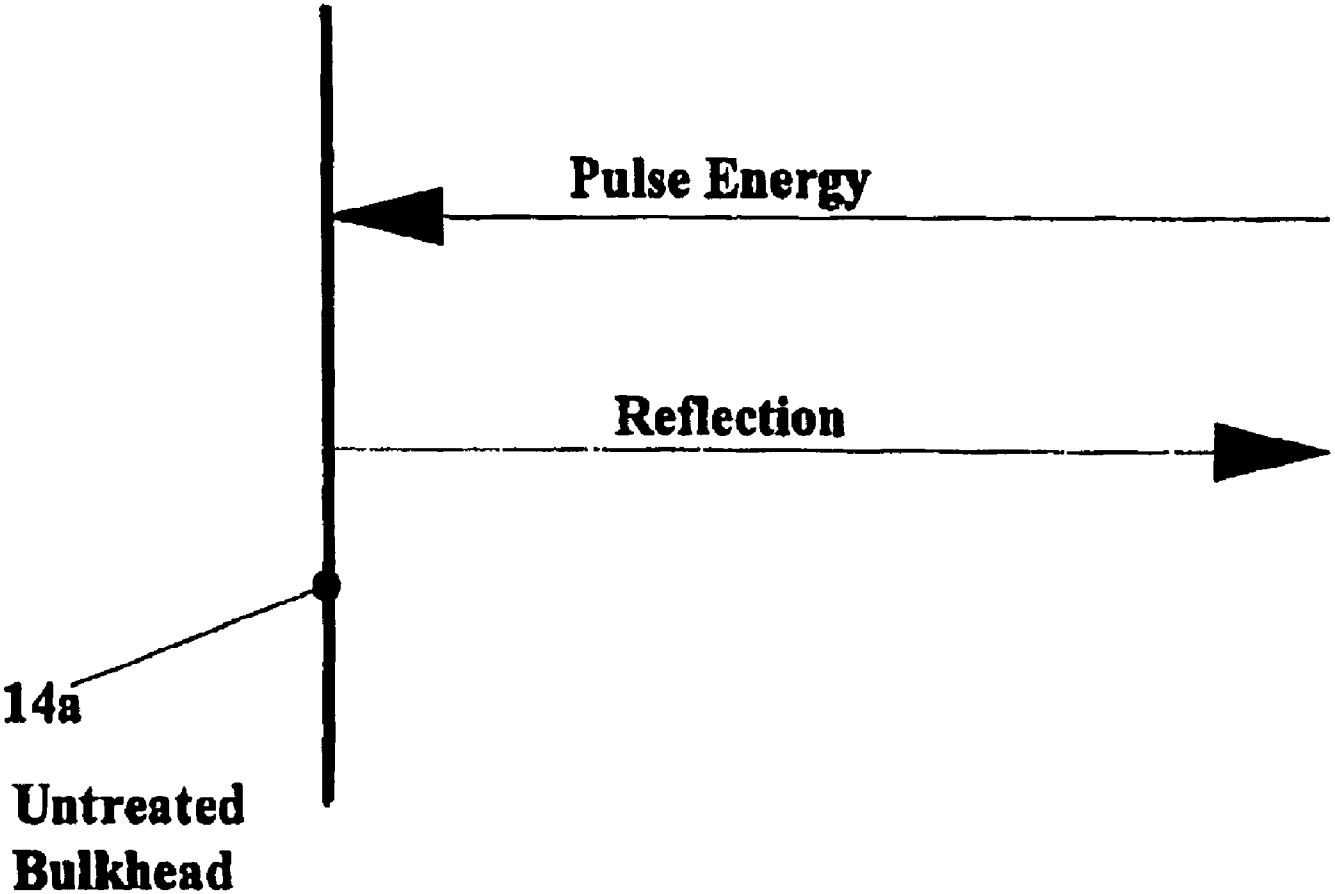
FIG. 1 is a schematic of the reflection pattern of a vessel without an array according to the invention.

Turning to the drawings, FIG. 1 shows a vertical surface 14*a* comprising, symbolically, a bulkhead of a vessel structure. In this arrangement a substantially horizontal incident radar signal (designated in FIG. 1 as "pulse energy") string vertical surface 14*a* (being normal to the incident radar signal) is reflected from the vertical surface 14*a* directly back to the radar source (not shown). It will be appreciated that a consequence of this arrangement is that the surface by virtue of its cross-section produces an easily discernible radar signature.

Figure 2:
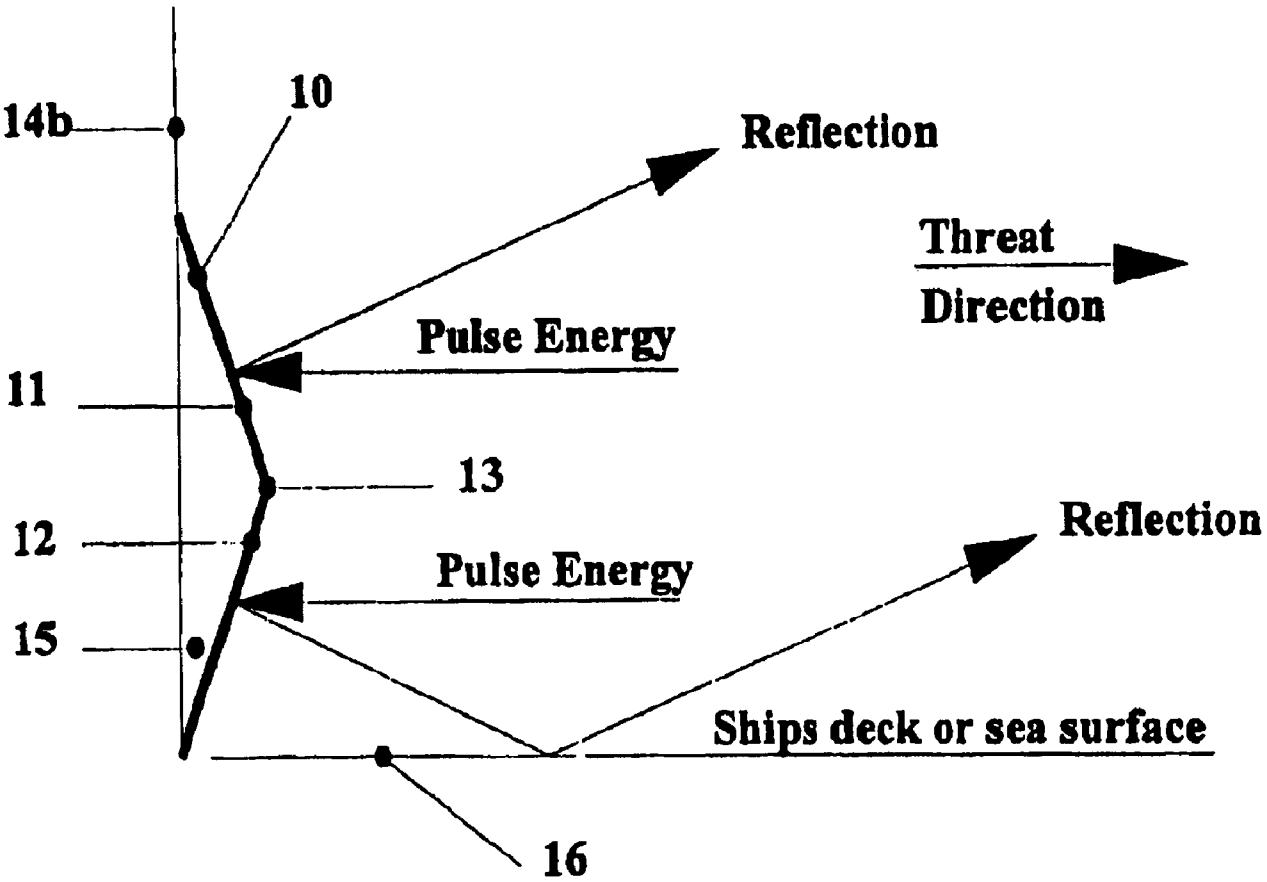
FIG. 2 is a schematic of the reflection profile of the bulkhead of a vessel structure to which one element of an array according to the invention is attached.

FIG. 2 shows symbolically a bulkhead 14*b* to which an array 10 has been attached. Array 10 comprises a plurality of elements (of which for convenience only one typical example designated 15 is shown in cross-section in this embodiment). The element 15 shown is triangular in cross-section and comprises reflective surfaces having substantially planar faces 11, 12 and a leading edge 13. It can be seen from this embodiment that the plan faces are oriented so as to be oblique to the horizontal direction of the incident radar (also designated in FIG. 2 as "pulse energy"). Although not clearly shown in FIG. 2, edge 13 can also be oriented so as to be oblique to the horizontal direction of the incident radar.

Figure 3:
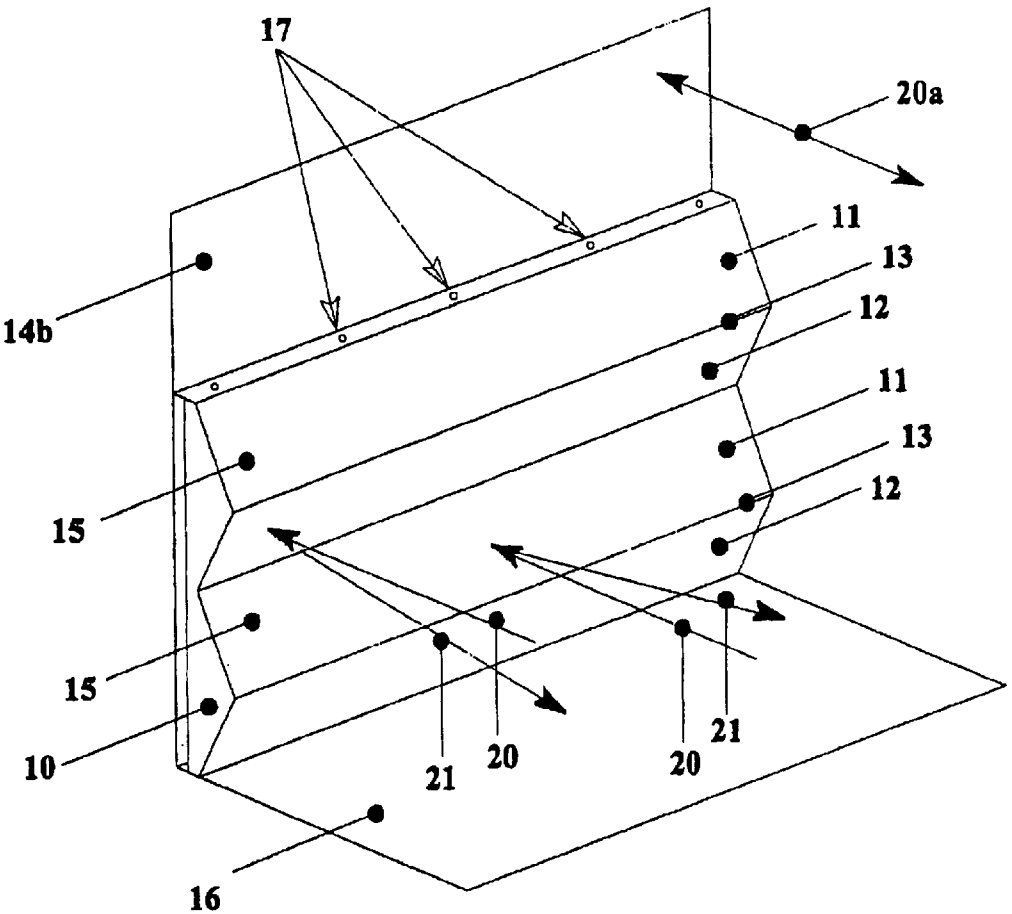
FIG. 3 is a cut-away perspective view of a side of a vessel to which an array according to the invention has been attached.

FIG. 3 shows part of an array 10 having a pair of elements 15 attached to the vertical surface of a bulkhead in the form of a ship's side 14*b* by concealed fastenings (that is, concealed from a given range of incident directions) in the form of screws 17.

Accordingly an incident radar signal 20 in a horizontal direction will be reflected in a direction 21 away from its direction of incidence on striking a planar face 11 or 12 of element 15. The angle of incidence of a reflected signal striking another part of the vessel structure, or the sea or ship deck 16 in the case of a water-borne craft will correspondingly be the same. The angle of reflection of the incident radar signal is preferably up to about 30 degrees away from the direction of the incident radar signal as shown in FIG. 2. By contrast, the untreated upper vertical surface of the ship's side 14*b* will reflect incident radar signal 20*a* directly back in the direction of its direction of incidence as that surface is normal to the direction of the incident radar signal 20*a*.

It will accordingly be appreciated that an array arrangement comprising a plurality of elements 15 is such that when attached to surfaces of the vessel structure the reflective surfaces 11, 12 of the elements 15 are oriented so as to reflect an incident radar signal in a direction away from its direction of incidence for a given range of incident directions. There is also a degree of control over the direction in which the electromagnetic waves are redirected, permitting other directions as well as the incident direction to be avoided, where required. The array 10 is formed from substantially non-porous material. If a reflective mesh with holes is used, the mesh holes are small relative to the wavelength of the incident radar signal 20*a* to enable the elements 15 to function as a solid reflector.

In use, and with reference to FIGS. 2 and 3, an array 10 in elongated aluminum sheet form comprising a plurality of shaped elements 15 of triangular cross-section and having reflective surfaces with substantially planar faces 11, 12 stamped, embossed, cast or otherwise formed thereon or therein is fastened to a vessel structure by stud welding following by securing with concealed fastenings in the form of screws 17. The orientation of the reflective surfaces and, if required, the edges 13 defining the boundary of the substantially planar faces 11, 12 is such that the reflective surfaces and the edges are oblique to the direction of incident radar for an incident horizontal directions, the arrangements being such that when fastened to surfaces of the vessel structure the reflective surfaces are orientated so as to reflect an incident radar signal by up to about 30 degrees away from the horizontal The present invention accordingly provides a cost-effective method for reducing the radar signature of an existing vessel and avoids the need to replace an existing vessel with an expensive purpose-built vessel.

The word 'comprising' and forms of the word 'comprising' as used in the description and in the claims does not limit the invention claimed to exclude any variants or additions.

Whilst it has been convenient to describe the present invention in relation to particularly preferred embodiments, it is to be appreciated that other constructions and arrangements are considered as falling within the scope of the invention. Various modifications, alterations, variations and/or additions to the constructions and arrangements described herein are also envisaged as falling within the scope of the present invention.

What is claimed is:

1. An array for retrofitting to a vessel to reduce its radar signature, the array capable of being fastened to surfaces of the vessel structure and comprising a plurality of elements having reflective surfaces with substantially planar faces, wherein when the array is fastened to the vessel structure the faces are oriented so as to coherently reflect an incident radar signal in a direction away from its direction of incidence for a given range of incident directions.

2. An array according to claim 1 wherein the orientation of the faces is such that the faces are arranged so as to be oblique to the direction of incident radar for a given range of incident direction.

3. An array according to claim 1 wherein any edges defining the boundary of the reflective surfaces are oriented so as to be oblique to the direction of incident radar for a given range of incident directions.

4. An array according to claim 1 wherein the reflective surfaces are oriented so as to coherently reflect an incident radar signal by up to about 30 degrees.

5. An array according to claim 1 wherein the reflective surfaces are oriented so as to reflect an incident radar signal by up to about 15 degrees.

6. An array according to claim 1 wherein the reflective surfaces are oriented so as to coherently reflect an incident radar signal by up to about 8 to 10 degrees.

7. An array according to claim 1 wherein the elements are triangular, polyhedral, pyramidal or prismatic in shape or in cross-section.

8. An array according to claim 1 wherein the elements are an elongated triangle, elongated polyhedron or elongated pyramid.

9. An array according to claim 1 wherein the elements are an apex disposed in a region which is forward relative to the planar faces of the reflective surfaces and collinear with respect to the incident radar signal.

10. An array according to claim 1 wherein the array comprises a plurality of uniform elements.

11. An array according to claim 10 comprising a grid of uniformly spaced elements having reflective surfaces with substantially planar faces.

12. An array according to claim 1 formed from a light-weight material.

13. An array according to claim 1 wherein the elements are perforated.

14. An array according to claim 1 wherein the array is formed from a mesh material.

15. An array according to claim 1, wherein said array is in roll or sheet form.

16. An array according to claim 15 wherein said sheet includes stiffening means to enhance the rigidity or resilience of said sheet.

17. An array according to claim 1 wherein the elements have a thickness in the range of from about 0.25 mm to 15 mm.

18. An array according to claim 17 wherein the element is of a thickness in the range of from about 1 mm to 6 mm.

19. A vessel have a structure to which is attached at least one array as claimed in claim 1.

20. A method of retrofitting an array to a vessel to reduce its radar signature, the array being as claimed in claim 1, the method including the step of attaching to surfaces of the vessel structure the array wherein the arrangement when attached to surfaces of the vessel structure results in the faces being oriented so as to coherently reflect an incident radar signal in a direction away from its direction of incidence for a given range of incident directions.

21. A method according to claim 20 wherein the array is fastened to the vessel structure by welding or by screw fastening to the structure.

22. A method according to claim 20, wherein the vessel structure comprises any surface on the structure capable of reflecting a radar signal.

23. A method according to claim 20, wherein the arrangement of elements on the vessel structure is such that the facets of the elements reflect the incident radar signal away from a threat direction.

24. A method according to claim 20, wherein the array comprises a plurality of sheets capable of being joined together.

25. A method for retrofitting an array to a vessel to reduce its radar signature, the array being as claimed in claim 1, the method including the step of fastening to surfaces of the vessel structure in sheet form one or more arrays comprising a plurality of uniformly shaped elements being triangular, polyhedral, pyramidal or prismatic in shape and having edges defining the boundary of the reflective surfaces being such that the faces and the edges are oblique to the direction of incident radar for a given range of incident directions, the arrangement being such that when fastened to surfaces of the vessel structure the reflective surfaces are oriented so as to coherently reflect an incident radar signal by up to about 30 degrees away from its direction of incidence for a given range of incident directions.

26. A retrofitted vessel made by the method of claim 20.

* * * * *